US008116671B2

(12) United States Patent
Li et al.

(10) Patent No.: US 8,116,671 B2
(45) Date of Patent: Feb. 14, 2012

(54) APPARATUSES USEFUL IN PRINTING ONTO MEDIA AND METHODS OF MITIGATING MEDIA EDGE WEAR EFFECTS ON FIXING BELTS IN PRINTING

(75) Inventors: Faming Li, Penfield, NY (US); Eric S. Hamby, Webster, NY (US); Augusto E. Barton, Webster, NY (US); Steven M. Russel, Bloomfield, NY (US); Erwin Ruiz, Rochester, NY (US); Brendan H. Williamson, Rochester, NY (US); Paul M. Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 187 days.

(21) Appl. No.: 12/714,830

(22) Filed: Mar. 1, 2010

(65) Prior Publication Data

US 2011/0211879 A1 Sep. 1, 2011

(51) Int. Cl.
*G03G 15/20* (2006.01)

(52) U.S. Cl. ..... 399/329; 399/394; 399/395

(58) Field of Classification Search ..... 399/68, 399/328, 329, 394, 395
See application file for complete search history.

(56) References Cited

U.S. PATENT DOCUMENTS

| | | | | |
|---|---|---|---|---|
| 5,410,394 | A * | 4/1995 | Wayman et al. | 399/329 |
| 6,026,274 | A * | 2/2000 | Aslam et al. | 399/329 |
| 7,013,107 | B2 | 3/2006 | Russel et al. | |
| 2008/0145114 | A1 | 6/2008 | Furukawa et al. | |

OTHER PUBLICATIONS

Faming Li et al.; U.S. Appl. No. 12/463,611, filed May 11, 2009.

* cited by examiner

*Primary Examiner* — Hoang Ngo
(74) *Attorney, Agent, or Firm* — Ronald E. Prass, Jr.; Prass LLP

(57) ABSTRACT

Apparatuses useful in printing and methods of mitigating media edge wear effects on fixing belts in printing are provided. An exemplary apparatus useful for printing onto media includes a first roll including a first surface; a second roll including a second surface; a fixing member including a third surface; a fixing belt supported on the first surface and second surface, the fixing belt including a surface forming a nip with the fixing member; a registration distribution system for translating the first roll, second roll, fixing member and fixing belt, as a unit, transversely with respect to a media travel path of media received at the nip; and a belt steering mechanism connected to the second roll for translating the fixing belt across the first surface of the first roll at the nip, transversely to the media travel path, while the registration distribution system translates the first roll, second roll, fixing member and fixing belt transversely to the media travel path.

22 Claims, 7 Drawing Sheets

APPARATUSES USEFUL IN PRINTING ONTO MEDIA AND METHODS OF MITIGATING MEDIA EDGE WEAR EFFECTS ON FIXING BELTS IN PRINTING

BACKGROUND

Some printing apparatuses include a nip formed by a roll and a belt. In these apparatuses, media are fed to the nip and contacted by the roll and belt to fix marking material onto the media. In these apparatuses, edges of the media can produce edge wear of the belt. Such edge wear can reduce image quality and reduce the life of the belt.

It would be desirable to provide apparatuses useful in printing onto media and methods that can mitigate edge wear of belts that contact the media.

SUMMARY

Apparatuses useful in printing onto media and methods of mitigating media edge wear effects on fixing belts in printing are provided. An exemplary embodiment of the apparatuses comprises a first roll including a first surface; a second roll including a second surface; a fixing member including a third surface; a fixing belt supported on the first surface and second surface, the fixing belt including a surface forming a nip with the fixing member; a registration distribution system for translating the first roll, second roll, fixing member and fixing belt, as a unit, transversely with respect to a media travel path of media received at the nip; and a belt steering mechanism connected to the second roll for translating the fixing belt across the first surface of the first roll at the nip, transversely to the media travel path, while the registration distribution system translates the first roll, second roll, fixing member and fixing belt transversely to the media travel path.

DRAWINGS

Figure 4:
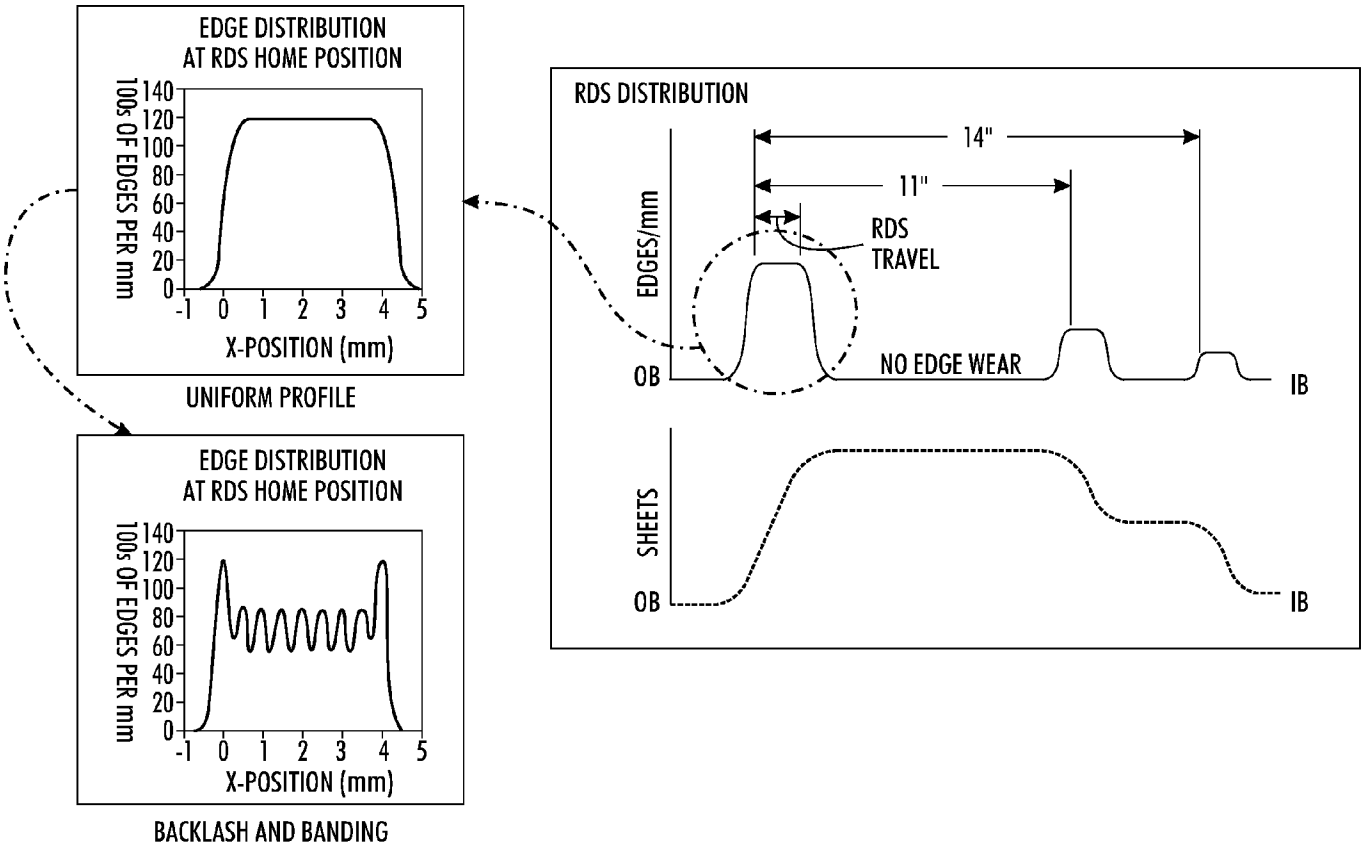

FIG. 4 depicts a wear distribution profile along a surface of a fixing belt in the axial direction of a fixing device from an outboard edge (OB) to an inboard edge (IB) for 11 inch and 14 inch media in an apparatus including a registration distribution system (RDS) that provides linear RDS movement without fixing belt steering, showing a uniform edge wear distribution profile (top left curve) and an edge wear distribution profile with backlash and banding at RDS home positions (bottom left curve).

Figure 5:
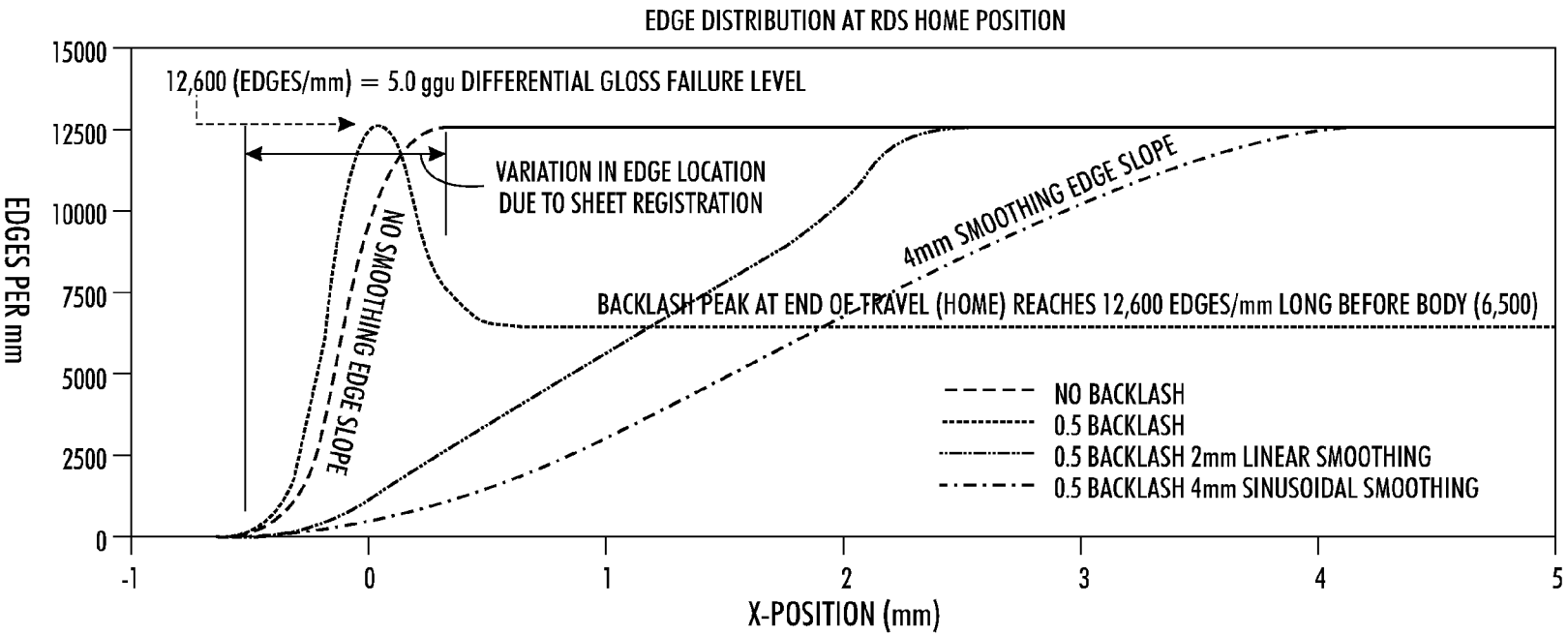

FIG. 5 depicts modeled wear distribution profiles along a fixing belt surface in the axial direction of a fixing device for the case where the fixing device is moved using a registration distribution system without fixing belt steering to smooth the edge slope, for the case of no backlash and no fixing belt steering, for the case of 2 mm linear smoothing, and the case of 4 mm sinusoidal smoothing.

Figure 6:
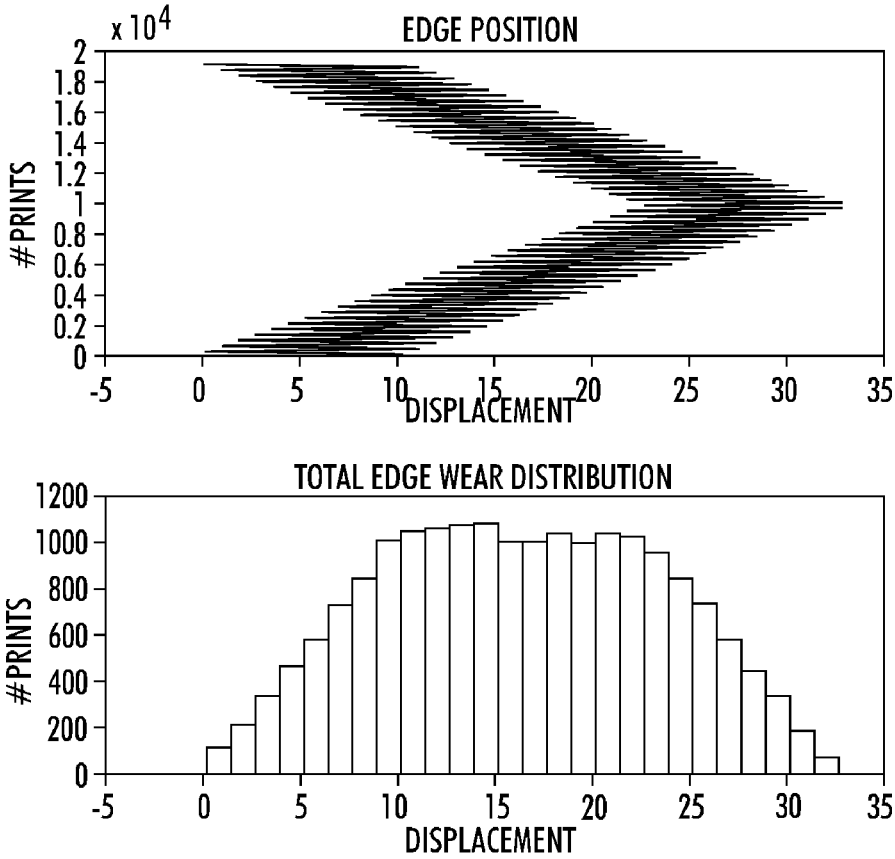

FIG. 6 depicts an exemplary relationship between fixing belt displacement in the width direction of a fixing belt and print number and edge pattern, respectively, using a linear RDS motion pattern for moving the fixing device in an apparatus including a registration distribution system (top curve) and fixing belt steering, and between fixing belt displacement in the axial direction and print number and total edge wear distribution, respectively, (bottom curve).

Figure 7:
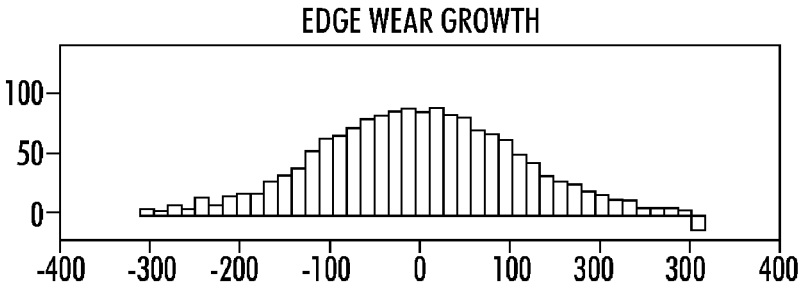

FIG. 7 depicts an exemplary bell-shaped, edge wear growth pattern in the width direction of a fixing belt produced by using a linear RDS motion pattern for moving the fixing device in an apparatus including a registration distribution system with fixing belt steering.

Figure 8:
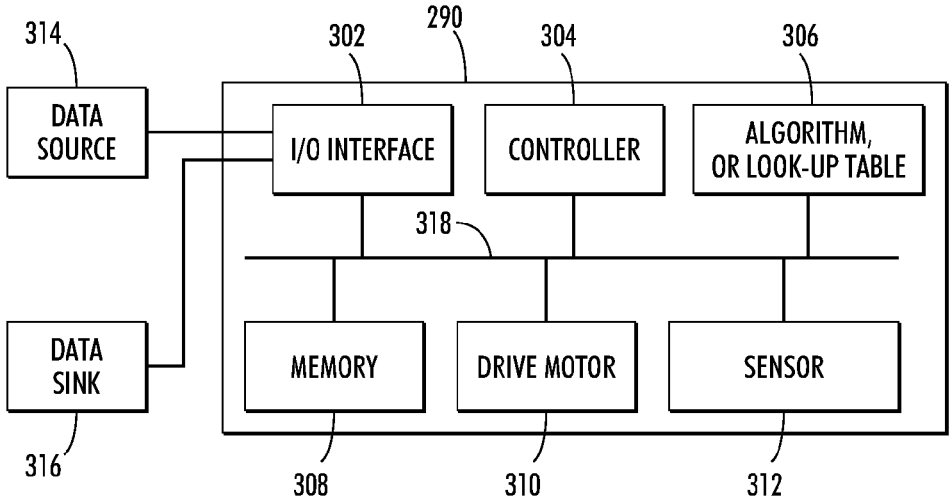

FIG. 8 depicts an exemplary embodiment of a registration distribution system for translating a fixing device relative to a media path in an apparatus useful in printing onto media.

DETAILED DESCRIPTION

The disclosed embodiments include apparatuses useful in printing onto media. An exemplary embodiment of the apparatuses comprises a first roll including a first surface; a second roll including a second surface; a fixing member including a third surface; a fixing belt supported on the first surface and second surface, the fixing belt including a surface forming a nip with the fixing member; a registration distribution system for translating the first roll, second roll, fixing member and fixing belt, as a unit, transversely with respect to a media travel path of media received at the nip; and a belt steering mechanism connected to the second roll for translating the fixing belt across the first surface of the first roll at the nip, transversely to the media travel path, while the registration distribution system translates the first roll, second roll, fixing member and fixing belt transversely to the media travel path.

The disclosed embodiments further include fixing devices. An exemplary embodiment of the fixing devices comprises a first roll including a first surface; a second roll including a second surface; a third roll including a third surface; a fixing belt supported on the first surface and the second surface, the fixing belt including a surface forming a nip with the third surface; a registration distribution system for translating the first roll, second roll, third roll and fixing belt, as a unit, transversely to a media travel path of media received at the nip; and a belt steering mechanism connected to the second roll for translating the fixing belt across the first surface of the first roll, at the nip, transversely to the media travel path, while the registration distribution system translates the first roll, second roll, third roll and fixing belt transversely to the media travel path.

The disclosed embodiments further include methods of mitigating media edge wear effects on fixing belts in apparatuses useful in printing onto media. In an exemplary embodiment of the methods, the apparatus comprises a first roll including a first surface, a second roll including a second surface, a fixing member including a third surface and a fixing belt supported on the first surface and second surface, with the fixing belt including a surface forming a nip with the fixing member. The method comprises feeding a medium to the nip along a media travel path; translating the first roll, second roll, fixing member and fixing belt, as a unit, transversely to the media travel path with a registration distribution system; and translating the fixing belt across the first surface at the nip, transversely to the media travel path, with a belt steering mechanism connected to the second roll, while the registration distribution system translates the first roll, second roll, fixing member and fixing belt transversely to the media travel path.

As used herein, the term "printing apparatus" encompasses apparatuses, such as digital copiers, facsimile machines, bookmaking machines, multifunction machines, and the like, or portions of such apparatuses, that perform a print outputting function for any purpose.

Figure 1:
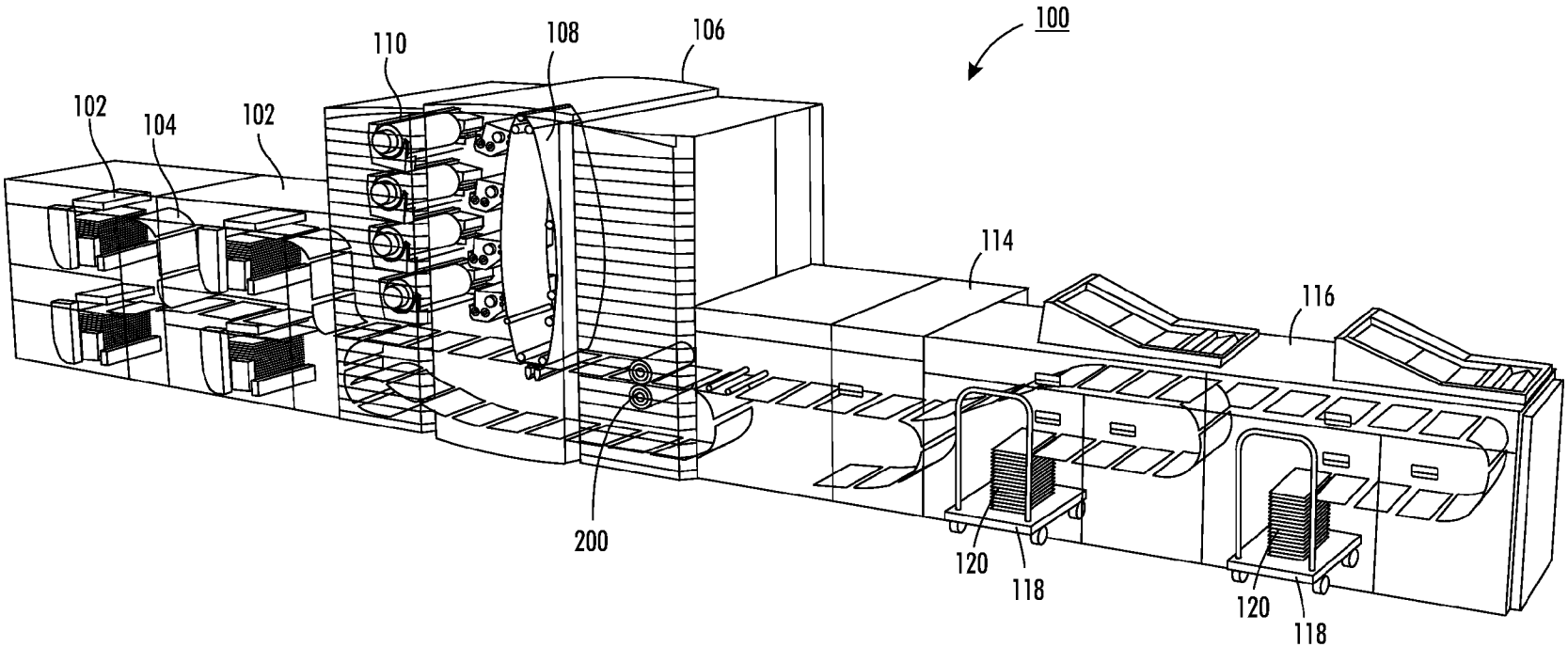
FIG. 1 depicts an exemplary embodiment of a printing apparatus.

FIG. 1 illustrates an exemplary printing apparatus 100 as disclosed in U.S. Patent Application Publication No. 2008/0037069, which is incorporated herein by reference in its entirety. The printing apparatus 100 can be used to produce prints from various types of media, such as coated or uncoated (plain) paper sheets, having various sizes and weights. The printing apparatus 100 includes two media feeder modules 102 arranged in series, a printer module 106 adjacent the media feeder modules 102, an inverter module 114 adjacent the printer module 106, and two stacker modules 116 adjacent the inverter module 114.

In the printing apparatus 100, the media feeder modules 102 feed media to the printer module 106. In the printer module 106, marking material (toner) is transferred from the developer stations 110 to a charged photoreceptor belt 108 to form toner images on the photoreceptor belt and produce prints. The toner images are transferred to one side of respective media 104 fed through the paper path. The media are advanced through a fixing device 200 including opposed rolls 113, 115 forming a nip to fix the toner images onto the media. The inverter module 114 manipulates media exiting the printer module 106 by either passing the media through to the stacker modules 116, or inverting and returning the media to the printer module 106. In the stacker modules 116, the media are loaded onto stacker carts 118 to form stacks 120.

Figure 2:
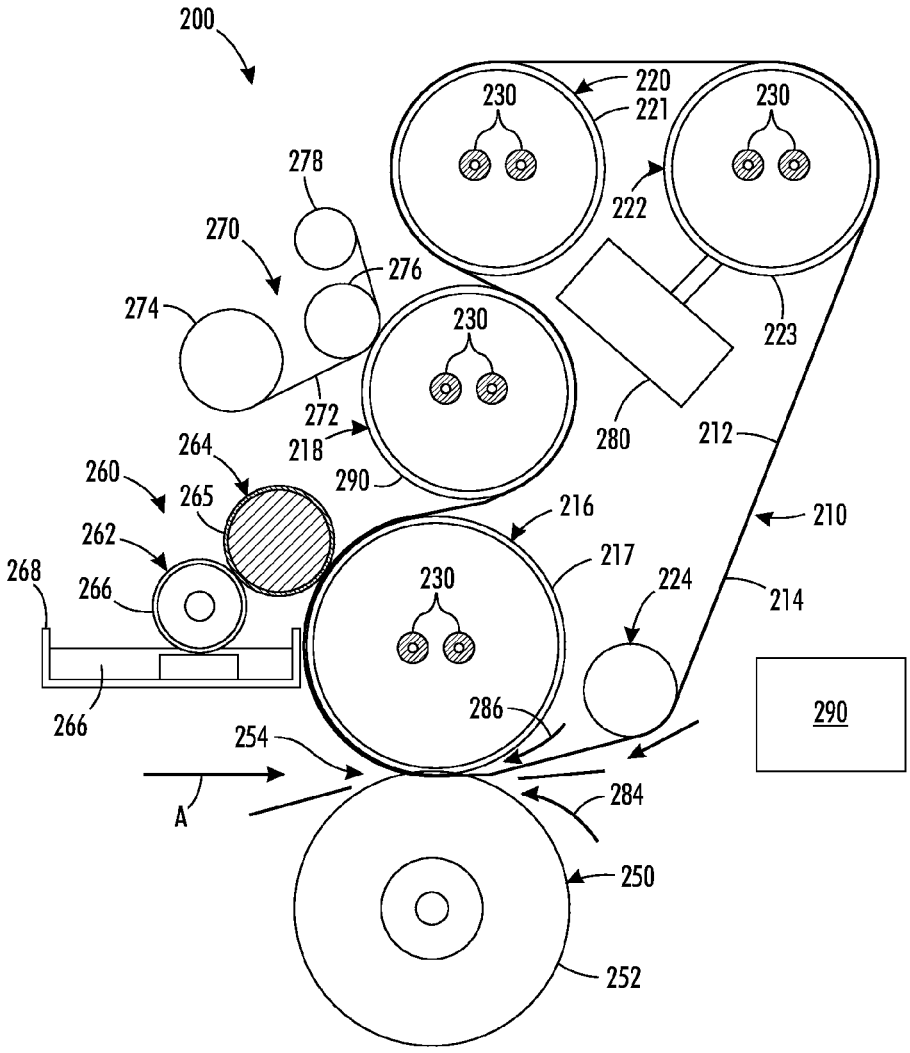
FIG. 2 depicts an exemplary embodiment of an apparatus useful in printing including a belt and roll forming a nip.

FIG. 2 illustrates an exemplary embodiment of an apparatus useful in printing onto media including a fixing device 200. The fixing device 200 includes a fixing roll 216 including an outer surface 217, and a pressure roll 250 having an outer surface 252 forming a nip 254 with the outer surface 217. In embodiments, the fixing roll 216 can be driven by a drive mechanism and the pressure roll 250 connected to a cam, or the like. The fixing roll 216 and pressure roll 250 rotate in opposite directions as indicated by respective arrows 286 and 284. At the nip 254, the fixing roll 216 and pressure roll 250 apply heat and pressure to fix marking material onto media fed to the nip 254 in the process direction A.

The fixing roll 202 can include a core and at least one layer overlying the core. For example, the core can be comprised of aluminum, or the like; an inner layer on the core can be comprised of an elastomeric material, such as silicone, or the like; and an outer layer including the outer surface 217 can be comprised of a fluoroelastomer sold under the trademark Viton® by DuPont Performance Elastomers, L.L.C., or the like.

The fixing roll 216 includes one or more heating elements (two heating elements 230 are shown). In embodiments, the heating elements 230 can be axially-extending lamps, or the like, powered by a power supply (not shown).

The pressure roll 250 can include a core and one or more layers overlying the core. For example, the core can be comprised of aluminum or the like, and an outer layer can be comprised of a suitable polymer, such as perfluoroalkoxy (PFA) copolymer resin, or the like.

The fixing device 200 includes a continuous fixing belt 210 having an inner surface 212 and an outer surface 214. An exemplary embodiment of the fixing belt 210 can comprise a base layer of polyimide, or like polymer; an intermediate layer of silicone, or the like, on the base layer; and an outer layer comprised of a conformable material, such as a fluoroelastomer sold under the trademark Viton® by DuPont Performance Elastomers, L.L.C., or a like polymer, on the intermediate layer. The base layer forms the inner surface 212 of the fixing belt 210, and the outer layer forms the outer surface 214.

The fixing belt 210 is supported on the outer surface 217 of the fixing roll 216, an external roll 218, internal rolls 218, 224 and a tension control roll 222. The external roll 218, internal roll 220 and tension control roll 222 include respective surfaces 219, 221 and 223 contacting the fixing belt 210.

The fixing belt 210 is heated by one or more of the supporting rolls. In embodiments, the fixing roll 216 and at least one of the external roll 218, internal roll 220 and tension control roll 222 can include an internal heat source 230 to supply thermal energy to the fixing belt 210, as shown. In embodiments, the heat sources 230 can be axially-extending heating lamps. The heat sources 230 can heat the belt 210 to a temperature effective to fix marking material onto media at the nip 254.

A belt steering mechanism 280 is operatively coupled to the steering control roll 222. The belt steering mechanism 280 includes a drive mechanism for steering the fixing belt 210 in an axial direction of the fixing device 200 with respect to the steering control roll 222, fixing roll 216, external roll 218 and internal roll 220. The orientation of the steering control roll 222 with respect to the fixing belt 210 is adjustable to change the direction of translation and lateral travel speed of the fixing belt 210. For example, the fixing belt 210 can be translated at a speed of less than about 1 mm/sec, such as less than about 0.5 mm/sec, relative to a fixed point in the apparatus.

A liquid supply system 260 is positioned to supply a liquid release agent to the outer surface 217 of the fixing roll 216. The liquid supply system 260 includes a metering roll 262 with an outer surface 263 and a donor roll 264 with an outer surface 265. The metering roll 262 contacts liquid release agent 266 contained in a sump 268. The metering roll 262 and donor roll 264 convey the release agent 266 from the sump 268 to the metering roll 262, from the metering roll 262 to the donor roll 264, and from the donor roll 264 to the outer surface 214 of the fixing belt 210.

The fixing device 200 further includes a belt cleaning system 270 including a cleaning web 272. The cleaning web 272 is supported on a web nip roll 276 connected to a web supply roll 278 and a web take-up roll 274. The cleaning web 272 is unwound from the web supply roll 278 and taken-up on the web take-up roll 274. The cleaning web 272 cleans the outer surface 214 of the fixing belt 210.

Figure 3:
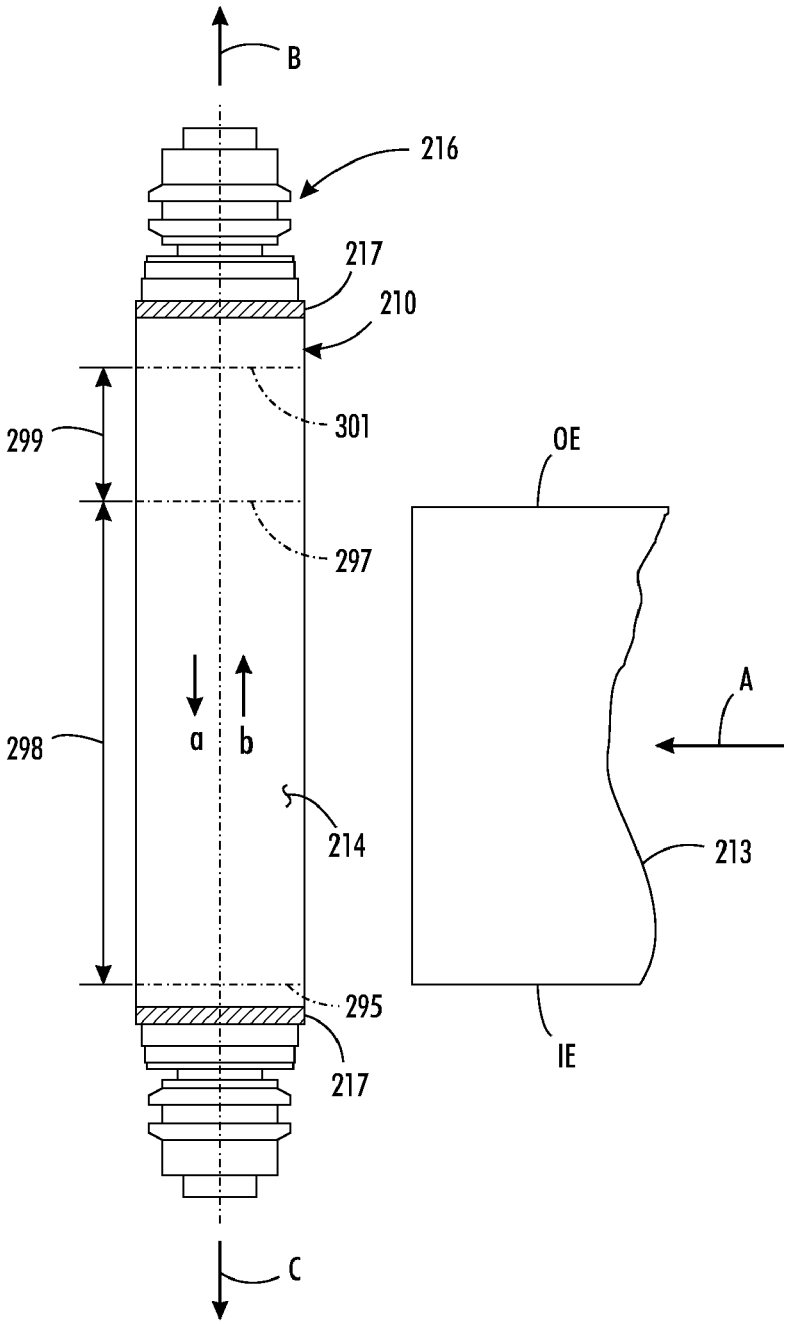
FIG. 3 depicts a medium being fed to the nip in the apparatus shown in FIG. 2.

FIG. 3 depicts a portion of the fixing device 200 shown in FIG. 2 including an exemplary embodiment of the fixing roll 216 and fixing belt 210. FIG. 3 shows the locations of media registration edge 295, outer edge 297, inside media path length 298 and outside media path length 299 of the fixing belt 210. The inside media path length 298 corresponds to the width of the medium 213, which has an inner edge IE registered at the media registration edge 295 and an outer edge OE positioned at outer edge 297 with respect to the outer surface 214 of the fixing belt 210. For example, the medium 213 can have a width of 11 inches (279 mm). The outside media path of the outer surface 214 is not contacted by the medium 213 when registered at the media registration edge 295. The outside media path is contacted by wider media. The location of an outer edge 301 of a wider medium, such as media having a width of 14 inches (356 mm), is shown.

When the medium 213 traveling in the process direction A is received at the nip 254 of the fixing device 200, the pressure roll 250 applies pressure to the fixing belt 210. This pressure acts at the inner edge IE of the medium 213, which is positioned at the media registration edge 295, and at the outer edge OE of the medium 213, which is positioned at the outer edge 297 of the inside media path length 298. This pressure produces mechanical strain on the outer layer of the fixing belt 210. Consequently, the outer surface 214 of the fixing belt 210 can be abraded at the locations of the media registration edge 295 and/or outer edge 297 at which the inner edge IE and outer edge OE of the medium 213 contact the outer surface 214. Elastomeric materials underlying the outer layer can also be abraded. This abrasion can produce edge wear in the outer surface 214 at the locations corresponding to the media registration edge 295 and outer edge 297. Such edge wear can cause fixing belts to fail. Edge wear also causes differential gloss artifacts in images formed on media when surface defects in the outer surface 214 of the fixing belt 210 are transferred to the media.

To mitigate the severity of edge wear in the fixing device 200, the entire fixing device 200 can be translated axially back and forth between maximum travel positions using a registration distribution system (RDS) 290. An exemplary embodiment of the registration distribution system 290 for use in the fixing device 200 is disclosed in U.S. Pat. No. 7,013,107, which is incorporated herein by reference in its entirety.

It has been noted that in registration distribution systems including a drive motor that stops and reverses direction when a maximum travel position is reached, "backlash" may occur in the drive system during the stopping and reversing of direction by the drive motor. For example, in registration distribution systems including a drive motor that moves the fixing device continuously from one maximum travel position to the other, there is a dwell period due to drive motor reversal at the end of each travel of the fixing device from one maximum travel position to the opposite maximum travel position. Backlash results in loss of motion of the fixing device at the maximum travel positions for the dwell period. During each dwell period, extra media pass over the same section of the fixing belt surface before motion of the fixing device in the opposite direction is resumed. The extra media increase edge wear at the sections of the fixing belt surface.

The fixing device 200 is translated relative to the fixed travel path of medium 213 traveling in process direction A using the registration distribution system 290. The fixing device 200 can be translated perpendicularly to the process direction A, across the media travel path. For example, the fixing device 200 can be translated in the direction B (FIG. 3) from a first endpoint to a second endpoint, then in the opposite direction C (FIG. 3) from the second endpoint back to the first endpoint, then in the direction B from the first endpoint to the second endpoint, then in the direction C from the second endpoint back to the first endpoint, etc. The distance and speed of travel in the direction B can be the same as that in the direction C. Using this pattern, the fixing device 200 can be moved repeatedly by the same distance and at the same speed in both directions B and C. This movement of the fixing device 200 axially distributes the positions of the media registration edge 295 and the outer edge 297, and the associated edge wear, over the outer surface 214 of the fixing belt 210.

It has been noted that when the fixing device 200 is translated continuously from the first endpoint to the second endpoint, then continuously from the second endpoint back to the first endpoint, in a repeated manner, a distinct step profile may form on the outer surface 214 of the fixing belt 210 at the locations of the first and second endpoints of travel. The step profile can transfer to media at the nip 254 and cause image artifacts, as well as shorten the service life of the fixing belt 210.

It has also been noted that when the registration distribution system 290 is not activated in the fixing device 200 and the fixing device 200 is not translated relative to the media travel path, or when the registration distribution system 290 is activated to translate the fixing device 200 while running heavy-weight media, circumferentially-extending abrasions can develop in the outer surface 214 of the fixing belt 210. These abrasions can map to distinct lines formed on media passed through the fixing device 200. This image artifact is referred to as "banding."

FIG. 4 depicts an exemplary wear distribution pattern formed on an outer surface of a fixing belt of a fixing device, as a function of the number of edges/mm and sheets in the axial direction along the outer surface, in an apparatus including a registration distribution system. Wear distribution patterns are shown for 11 inch and 14 inch media. In FIG. 4, "OB" and "IB" indicate the positions of the outboard and inboard edges of the fixing belt. FIG. 4, top left curve, shows an intended uniform media edge distribution profile at registration distribution system home positions (i.e., maximum travel positions of the fixing belt). In this profile, the effects of backlash on edge wear are spread out along the axial direction of the outer surface of the fixing belt.

FIG. 4, bottom left curve, shows an edge distribution profile at registration distribution system home positions when motor reversal backlash occurs during travel of the fixing belt, when the fixing belt is moved to the same two end positions during travel. As shown, the backlash produces a higher concentration of paper edges at the ends of the profile corresponding to the maximum travel positions of the fixing belt. As a result, differential gloss increases significantly when the fixing belt is positioned at each end of travel of the RDS travel zone.

FIG. 4, bottom left curve, also shows banding (represented by smaller peaks) occurring between the two end positions with the use of the registration distribution system. Such banding, in addition to backlash, can occur when heavy-weight paper is run in the fixing device.

In light of these observations, apparatuses useful in printing onto media that are constructed to mitigate edge wear are provided. Embodiments of the apparatuses can mitigate edge wear of surfaces of fixing belts by moving the fixing belts using two different mechanisms simultaneously. In embodiments, the fixing belt is moved by combining motions provided by a registration distribution system, which can move the entire fixing device including the fixing belt, and a belt steering system, which can simultaneously move the fixing belt with respect to the moving fixing device. In the apparatuses, the fixing belt can be maintained within a desired axial spatial range relative to the fixing belt by the belt steering system. The belt steering system can move the fixing belt in a constant back and forth motion, for example, to distribute the edge wear within the range. When the belt steering motion is combined with the motion of the fixing device provided by the registration distribution system, the belt steering can mitigate the effects of both backlash and banding.

Embodiments of the registration distribution system translate the fixing device relative to the media travel path of media through the nip. The media travel path is typically fixed in the apparatuses. The fixing device 200 (FIG. 2) can be translated axially relative to the travel path of the medium 213 through the nip 254. Embodiments of the fixing device 200 can have a modular construction, and the entire module can be translated using a registration distribution system 290 connected to the fixing device 200. The registration distribution system 290 can include an external drive mechanism constructed to translate the entire fixing device 200 in the desired manner.

The fixing device 200 is moved relative to the media travel path by the registration distribution system 290 when printing is performed in the apparatus. The movement of the fixing device 200 can be started when media approaching the nip 254 are sensed. Media can be sensed by an optical sensor, or the like, positioned along the media travel path at a location upstream from the nip 254 in the apparatuses. Alternatively, media can be sensed with a digital front end, which initiates the printing process and notifies each sub-system that media are arriving. In embodiments, when printing is resumed after delay or completion of a previous print run, the movement of the fixing device 200 is resumed from the position it stopped at, i.e., the starting position of the fixing device 200 is not re-set when printing is resumed.

The fixing device 200 can be translated continuously in direction C (FIG. 3) to move a reference position on the fixing belt 210 (e.g., media registration edge 295), and then translated continuously in the reverse direction D (FIG. 3) to move the reference position in that direction. The directions C and D can be perpendicular to the process direction A. This back and forth motion of the fixing device is repeated during printing.

While the fixing device 200 is being translated relative to the media travel path by the registration distribution system 290, the fixing belt 210 is also moved with respect to the outer surface 217 of the fixing roll 216 by the belt steering mechanism 280 coupled to the steering control roll 222. The fixing device 200 is moved by the registration distribution system 290 at a speed, $s_{fd}$, (relative to a fixed point in the apparatus), while the fixing belt 210 is moved at a speed, $s_{fb/fd}$, relative to the moving fixing device 200 by the belt steering mechanism 280.

In embodiments, the belt steering mechanism 280 can translate the fixing belt 210 at a uniform speed back and forth (i.e., a triangular waveform). In other embodiments, the belt steering mechanism 280 can move the fixing belt 210 according to other forms, such as a triangular form (i.e., s=sin(t), where s is speed and t is time).

FIG. 3 shows that the fixing belt 210 can be moved in a first direction, a, and then in an opposite second direction, b, relative to the outer surface 217 of the fixing roll 216 by the belt steering mechanism 280. The direction a and the direction b along which the fixing belt 210 is moved can be parallel to the directions, A and B, along which the fixing device 200 is moved. The belt steering mechanism 280 can translate the fixing belt 210 continuously in the direction a, and continuously in the direction b, relative to the outer surface 217 of the moving fixing roll 216. The fixing belt 210 can be translated at a different speed than the entire fixing device 200 (relative to a fixed point in the apparatus). Both backlash and banding can be masked by this motion of the fixing belt 210.

FIG. 5 illustrates modeled results demonstrating effects of smoothing provided by moving a fixing belt using a belt steering mechanism in a fixing device. As shown, a curve with "0.5 backlash" (about 0.5 mm backlash) has a peak value of 12,600 edges/mm. This curve corresponds to a case where the fixing device is moved relative to the media travel path using a registration distribution system, but without belt steering, i.e., "smoothing," to smooth the wear distribution profile. FIG. 5 also shows a curve for a case of using no smoothing ("no smoothing edge slope"), where the nominal case of no backlash is modeled. For this curve, the axial variation in edge location due to sheet registration is shown.

FIG. 5 also shows a curve for the case of moving the fixing device linearly with a registration distribution system in combination with steering the fixing belt using a 2 mm linear smoothing motion, with 0.5 mm backlash; and a curve for the case of moving the fixing device linearly with a registration distribution system in combination with steering the fixing belt using a 4 mm smoothing motion with a sinusoidal waveform, with 0.5 mm backlash. The edge wear is smoothed over a larger range using the 4 mm smoothing motion. These two curves demonstrate that using a smoothing profile can spatially distribute edge wear on the fixing belt to mask the effects of backlash, and that combining a linear motion of the fixing device provided by a registration distribution system with a belt smoothing motion provided by belt steering mechanism also masks banding.

In addition to backlash and banding, two other edge wear profile characteristics that can be addressed by the combined use of a registration distribution system and a belt steering mechanism are the shape and growth of the edge wear profile. The shape of the edge wear profile is dependent on the types of media that are run in the fixing device and the degree of uniformity of movement of the fixing device by the registration distribution system.

For the growth of the edge wear profile, edge wear density is proportional to the differential gloss. To make edge wear artifacts less visible on prints, it is desirable to produce a bell-shaped edge wear profile that is smooth during the entire service life of the fixing belt.

In the fixing device, the fixing belt 210 is actively steered by the belt steering mechanism 280 to be maintained within a desired range with respect to the outer surface 214 of the fixing belt 210. Media edges are distributed over the outer surface 214 of the fixing belt 210 by the belt steering mechanism 280. The steering range of the fixing belt 210 is limited by the width of the fixing belt 210 and the length of the outer surface 217 of the fixing roll 216. The registration distribution system 290 distributes the media edges over a wider range on the outer surface 214 of the fixing belt 210. By using a constant steering motion produced by the belt steering mechanism 280 in combination with the registration distribution system 290, backlash and banding, which can occur when using the registration distribution system 290 alone, are smoothed out.

FIG. 6 shows the media edge wear accumulation or density (number of prints as a function of displacement along the outer surface 214 of the fixing belt 210) when the fixing belt 210 is moved in the fixing device 200 using a combined motion provided by the registration distribution system 290 and the belt steering mechanism 280. The top curve shows the number of prints as a function of edge position and the bottom curve shows the total edge wear distribution (i.e., accumulated number of media edges). The media edge density has a smooth profile, with the shape of the profile being dependent on the belt steering range provided by the belt steering mechanism 280 and the travel speed and travel distance of the fixing device provided by the registration distribution system 290. In embodiments, the slope and peak of the media edge density profile can be optimized to maximize fixing belt edge wear life.

FIG. 7 depicts a modeled desirable edge wear growth profile resulting from moving the fixing device 200 using the registration distribution system 290 and moving the fixing belt 210 using the belt steering mechanism 280. As shown, the profile resembles a bell shape as the edge wear accumulates.

In embodiments, the motion pattern provided by using the registration distribution system 290 can be adjusted based solely on visual observations of the edge wear profile of the fixing belt 210, without also taking into consideration a characteristic of the media run in the apparatus to produce the edge wear profile, such as media weight. For example, the edge wear shape can be observed or measured after a certain number of prints (e.g., 10,000 prints) have been made with the fixing device 200. Based on the edge wear shape, the motion pattern can be adjusted to compensate for undesirable aspects of the observed wear profile and produce a profile having a desired shape, e.g., the bell shape shown in FIG. 7.

In embodiments, feedback of image gloss measurements, which relate to edge wear density, can be used for motion adjustment purposes. Based on this feedback, the movement of the fixing device 200 by the registration distribution system 290 can be controlled to smooth transient gloss in real time, or periodically at selected times. In the fixing device 200, the belt steering functions as a fast local actuator and the registration distribution system 290 functions as a slow global actuator. The use of the registration distribution system 290 combined with belt steering can generate desired edge wear density profiles. For example, the travel speed of the fixing device 200 provided by the registration distribution system 290 can be adjusted based on feedback to conform the edge density profile to a bell shape. For printing heavy-weight media, the fixing device 200 can be moved at a higher speed to reduce banding and maintain a smooth bell shape of the edge density profile.

In embodiments, the motion of the fixing device 200 provided by the registration distribution system 290 and the motion of the fixing belt 210 provided by the belt steering mechanism 280 can be independent of each other, i.e., not correlated. For example, the motion of the fixing device 200 provided by the registration distribution system 290 can be adjusted without also adjusting the motion of the fixing belt 210 provided by the belt steering mechanism 280.

In embodiments, the methods of mitigating edge wear of fixing belts in apparatuses useful in printing onto media can be integrated in closed-loop edge wear control systems. FIG. 8 depicts an exemplary embodiment of the registration distribution system 290 shown in FIG. 2. The registration distribution system 290 includes a data source 314 connected over a link to an input/output (I/O) interface 302. A data sink 316 is connected to the input/output interface 302 through a link. Each of the links can be implemented using any known or later developed device or system for connecting the data source 314 and the data sink 316, respectively, to the registration distribution system 290.

The input/output interface 302 inputs data from the data source 314 and outputs data to the data sink 316 via the link. The input/output interface 302 also provides the received data to one or more of a controller 304, memory 308, and an algorithm or look-up table 306. The input/output interface 302 receives data from one or more of the controller 304, memory 308, and/or the algorithm or look-up table 306.

The algorithm or look-up table 306 provides instructions to the controller 304 based on data to smooth the edge wear profile of the fixing belt 210. The controller 304 controls the drive motor 310 to move the fixing device 200 according to the instruction sent to the controller 304 by the algorithm or look-up table 306. The algorithm or look-up table 306 may be implemented as a circuit or routine of a suitably programmed general purpose computer.

The memory 308 stores data received from the algorithm or look-up table 306, the controller 304, and/or the input/output interface 302. The memory 308 can also store control routines used by the controller 304 to operate the drive motor 310 to move the fixing device 200 according to the algorithm or look-up table 306 upon receipt of a signal from a sensor 312. In embodiments, the sensor 312 detects the location of a reference point of the fixing device 200, such as a point on the fixing belt 210, relative to a fixed position, such as one edge of the media travel path through the nip.

In one exemplary embodiment of the registration distribution system 290, the sensor 312 is tripped by a flag provided on the fixing device 200, causing a signal to be sent to the input/output interface 302. The signal is also sent to the memory 308 and the algorithm or look-up table 306 via the bus 318. The instructions for moving the fixing device 200 are sent from the algorithm or look-up table 306 to the drive motor 310. The drive motor 310 can be synchronized with the sensor 312 to move the fixing device 200 in opposite axial directions, such as depicted in FIG. 3.

It will be understood that the teachings and claims herein can be applied to any treatment of marking materials on media. For example, the marking material can be toner, liquid or gel ink, and/or heat- or radiation-curable ink. The process conditions, such as temperature, pressure and dwell time, which may be suitable for treating different marking materials, may vary in different embodiments of the apparatuses and methods.

It will be appreciated that various ones of the above-disclosed, as well as other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An apparatus useful in printing onto media, comprising:
- a first roll including a first surface;
- a second roll including a second surface;
- a fixing member including a third surface;
- a fixing belt supported on the first surface and second surface, the fixing belt including a surface forming a nip with the fixing member;
- a registration distribution system for translating the first roll, second roll, fixing member and fixing belt, as a unit, transversely with respect to a media travel path of media received at the nip; and
- a belt steering mechanism connected to the second roll for translating the fixing belt across the first surface of the first roll at the nip, transversely to the media travel path, while the registration distribution system translates the first roll, second roll, fixing member and fixing belt transversely to the media travel path.

2. The apparatus of claim 1, wherein the belt steering mechanism translates the fixing belt across the first surface continuously in a first direction and then continuously in a second direction opposite to the first direction, while the registration distribution system translates the first roll, second roll, fixing member and fixing belt transversely to the media travel path.

3. The apparatus of claim 2, wherein the belt steering mechanism translates the fixing belt across the first surface in each of the first direction and the second direction by a distance of about 2 mm to about 4 mm and at a speed of less than about 1 mm/sec relative to a fixed point in the apparatus.

4. The apparatus of claim 2, wherein the belt steering mechanism translates the fixing belt across the first surface in a linear motion.

5. The apparatus of claim 2, wherein the belt steering mechanism translates the fixing belt across the first surface according to a sinusoidal waveform.

6. The apparatus of claim 2, wherein:
- the registration distribution system translates the first roll, second roll, fixing member and fixing belt continuously in a third direction and then continuously in a fourth direction opposite to the third direction; and
- the third direction and the fourth direction are substantially perpendicular to a process direction of the media received at the nip.

7. The apparatus of claim 1, wherein the first roll and the second roll each includes an internal heat source for supplying thermal energy to the fixing belt.

8. A fixing device, comprising:

a first roll including a first surface;

a second roll including a second surface;

a third roll including a third surface;

a fixing belt supported on the first surface and the second surface, the fixing belt including a surface forming a nip with the third surface;

a registration distribution system for translating the first roll, second roll, third roll and fixing belt, as a unit, transversely to a media travel path of media received at the nip; and a belt steering mechanism connected to the second roll for translating the fixing belt across the first surface of the first roll, at the nip, transversely to the media travel path, while the registration distribution system translates the first roll, second roll, third roll and fixing belt transversely to the media travel path.

9. The fixing device of claim 8, wherein the belt steering mechanism translates the fixing belt across the first surface continuously in a first direction and then continuously in a second direction opposite to the first direction, while the registration distribution system translates the first roll, second roll, third roll and fixing belt relative to the media travel path.

10. The fixing device of claim 9, wherein the belt steering mechanism translates the fixing belt across the first surface in each of the first direction and the second direction by a distance of about 2 mm to about 4 mm and at a speed of less than about 1 mm/sec relative to a fixed point.

11. The fixing device of claim 9, wherein the belt steering mechanism translates the fixing belt across the first surface in a linear motion.

12. The fixing device of claim 9, wherein the belt steering mechanism translates the fixing belt across the first surface according to a sinusoidal waveform.

13. The fixing device of claim 9, wherein:

the registration distribution system translates the first roll, second roll, third roll and fixing belt continuously in a third direction and then continuously in a fourth direction opposite to the third direction; and the first direction, second direction third direction and fourth direction are each substantially perpendicular to a process direction of the media received at the nip.

14. The fixing device of claim 8, wherein each of the first roll and the second roll includes an internal heat source for supplying thermal energy to the fixing belt.

15. A method of mitigating media edge wear effects on a fixing belt in an apparatus useful in printing onto media, the apparatus comprising a first roll including a first surface, a second roll including a second surface, a fixing member including a third surface and a fixing belt supported on the first surface and second surface, the fixing belt including a surface forming a nip with the fixing member, the method comprising:

feeding a medium to the nip along a media travel path;

translating the first roll, second roll, fixing member and fixing belt, as a unit, transversely to the media travel path with a registration distribution system; and translating the fixing belt across the first surface at the nip, transversely to the media travel path, with a belt steering mechanism connected to the second roll, while the registration distribution system translates the first roll, second roll, fixing member and fixing belt transversely to the media travel path.

16. The method of claim 15, further comprising:

passing a plurality of media through the nip; and for each medium, translating the fixing belt across the first surface at the nip with the belt steering mechanism while the registration distribution system translates the first roll, second roll, fixing member and fixing belt relative to the media travel path;

wherein an edge wear profile having a bell shape is formed between axially spaced locations on the surface of the fixing belt.

17. The method of claim 15, further comprising:

passing a plurality of media through the nip;

for each medium, translating the fixing belt across the first surface at the nip with the belt steering mechanism while the registration distribution system translates the first roll, second roll, fixing member and fixing belt relative to the media travel path;

determining an axial edge wear profile of the surface of the fixing belt resulting from passing the plurality of media through the nip; and adjusting a translation speed of the first roll, second roll, fixing member and fixing belt relative to the media travel path with the registration distribution system when the determined edge wear profile varies from a desired edge wear profile.

18. The method of claim 17, wherein the desired edge wear profile has a bell shape between axially spaced locations on the surface of the fixing belt.

19. The method of claim 15, wherein:

the registration distribution system translates the first roll, second roll, fixing member and fixing belt continuously in a first direction and then continuously in a second direction opposite to the first direction;

the belt steering mechanism translates the fixing belt across the first surface continuously in a third direction and then continuously in a fourth direction opposite to the third direction transversely to the media travel path, while the registration distribution system translates the first roll, second roll, fixing member and fixing belt transversely to the media travel path; and the first direction, second direction, third direction and fourth direction are each substantially perpendicular to a process direction of the medium received at the nip.

20. The method of claim 19, wherein the belt steering mechanism translates the fixing belt across the first surface in the first direction and the second direction by a distance of about 2 mm to about 4 mm and at a speed of less than about 1 mm/sec relative to a fixed point.

21. The method of claim 19, wherein the belt steering mechanism translates the fixing belt across the first surface in a linear motion.

22. The method of claim 19, wherein the belt steering mechanism translates the fixing belt across the first surface using a sinusoidal waveform.

* * * * *